United States Patent [19]

Appleman

[11] 4,279,347

[45] Jul. 21, 1981

[54] ANTI-SWAY LOAD HANDLING APPARATUS

[75] Inventor: William S. Appleman, Durham, N.C.

[73] Assignee: RPC Corporation, Roxboro, N.C.

[21] Appl. No.: 74,788

[22] Filed: Sep. 12, 1979

[51] Int. Cl.[3] ..... B66C 13/06

[52] U.S. Cl. ..... 212/147; 212/208; 212/220

[58] Field of Search ..... 212/146–148, 212/208, 210, 218, 220; 414/460

[56] References Cited

U.S. PATENT DOCUMENTS

| | | | |
|---|---|---|---|
| 3,161,309 | 12/1964 | Baudhuin et al. | 212/218 X |
| 3,176,853 | 4/1965 | Baudhuin et al. | 212/220 |
| 3,251,496 | 5/1966 | Lamer et al. | 212/220 X |
| 3,358,172 | 1/1971 | Lamer et al. | 212/220 X |

*Primary Examiner*—Robert G. Sheridan

*Attorney, Agent, or Firm*—Bruce M. Winchell

[57] ABSTRACT

A load handling apparatus 10 having an anti-sway characteristic produced by suspending one end of a load bearing member 44 from a first trolley 38 which resists sway laterally along cross member 24 and the other end from a second trolley 54 which rides on a vertically movable stabilizing beam 30 to resist sway both laterally along stabilizing beam 30 and along the major axis of the load bearing member 44.

23 Claims, 5 Drawing Figures

ANTI-SWAY LOAD HANDLING APPARATUS

BACKGROUND OF THE INVENTION

The present invention generally relates to a load handling apparatus of the mobile type having a gantry from which is hung a series of lifting devices for lifting large loads such as piggy-back trailers or cargo containers off of a vessel or vehicle. More particularly the present invention relates to an anti-sway load handling apparatus adapted to move large bulky loads with a minimum of sway both longitudinally and transverse the major axis of the length of the load. Such a load handling apparatus is capable of quicker and more accurate placement of a load and removal thereof.

Description of the Prior Art

Mobile load handling devices with a grapple apparatus or a conventional load bearing beam have been used for many years for lifting and transporting large bulky items such as piggy-back trailers to and from the railway flat cars or containers containing cargo being lifted and placed in and out of the cargo hold of a ship. Many of these devices have been limited in terms of the speed with which they may move a cargo from side to side or forward and aft by reason of the sway of the cargo as suspended from the gantry of the load handling apparatus. This causes problems in terms of exact placement of a load and also in terms of possible safety problems with regard to the load swinging into something which is highly undesirable. To overcome the swinging of the load, the common solution was to reduce the speed of the operation so as to minimize the swing of the load thus substantially reducing the danger involved and increasing the accuracy of load placement.

A more recent method of stabilizing a load was to employ the use of two vertically suspended stabilizing beams between the upright supports of the gantry having the stabilizing beams connected directly to the load carrying member so as to eliminate the suspension of cable which allowed the sway of the load. These devices generally employed the use of two trolleys upon the stabilizing beams and additionally in order to permit the angling of the load with respect to the granty crane itself, a set of rollers was provided on generally one end of the load supporting member for adjustment of the length of the member in accordance with the angle traversed by the two trolleys to take up any slack or excess in length between the two stabilizing beams. One major problem of this apparatus however was that the load carrying beam must be sufficiently long to traverse the entire diagonal length of the most extreme angular disposition of the load which would be desired in the operation of the load handling apparatus. The alternative was to shorten significantly the distance between the stabilizing beams upon the gantry thus also reducing the general stability of the load handling apparatus.

Therefore it would be exceedingly advantageous in terms of safety, versatility and stability in handling heavy bulky loads with such a load handling apparatus to provide such an apparatus as would cure the defects of the prior art devices.

SUMMARY OF THE INVENTION

Accordingly, it is an object of the present invention to provide a load handling apparatus having anti-sway characteristics which would enhance the safety of operation of such a device in addition to increasing the speed with which loads could be transferred utilizing such a device.

It is another object of the present invention to provide a load handling apparatus having anti-sway characteristics such as to be more economical to manufacture and easier therefore to maintain in good operating condition.

It is a further object of the present invention to provide a load handling apparatus with anti-sway characteristics in all directions allowing for independent operation of either end of the load handling device so as to provide better control of loads within given anti-sway stability requirements.

It is a still further object of the present invention to reduce the weight of the load handling apparatus and to additionally provide a means for traversing a relatively uneven surface with a load.

It is another object of the present invention to permit angular disposition of a load with respect to the gantry without the limitations of the length of the load bearing means or the distance between the stabilizing beams.

These and other objects of the present invention, together with the advantages thereof over existing and prior art forms, will become apparent to those skilled in the art from the following specification.

It has been found that a load handling apparatus can comprise the pair of spaced upright support frames; at least one cross member connecting between the spaced upright support frames; a stabilizing beam vertically movable upon the spaced upright support frames at one end of the spaced upright support frames; a first trolley movable laterally upon the cross member at the opposite end of the upright support frames from the stabilizing beam; a sheave block movable vertically with relation to and connected to the first trolley; load bearing means for bearing the load connected to the sheave block; connection means for connecting the load bearing means to the sheave block to allow rotational movement on the horizontal plane and vertical angular movement along the major axis of the load bearing means; a second trolley movable laterally upon the stabilizing beam; the load bearing means connected to the second trolley at the opposite end of its major axis to allow rotational movement on the horizontal plane; and reeving connecting the sheave block to the first trolley as to allow translational movement along the major axis of the load bearing means while resisting all other movement of the load bearing means in relation to the first trolley.

The following embodiments of the subject apparatus for load handling is shown by way of example in the accompanying drawings without attempting to show all of the various forms and modifications in which the invention might be embodied; the invention being measured by the appended claims and not by the details of this specification.

DESCRIPTION OF THE PREFERRED EMBODIMENTS

Figure 1:
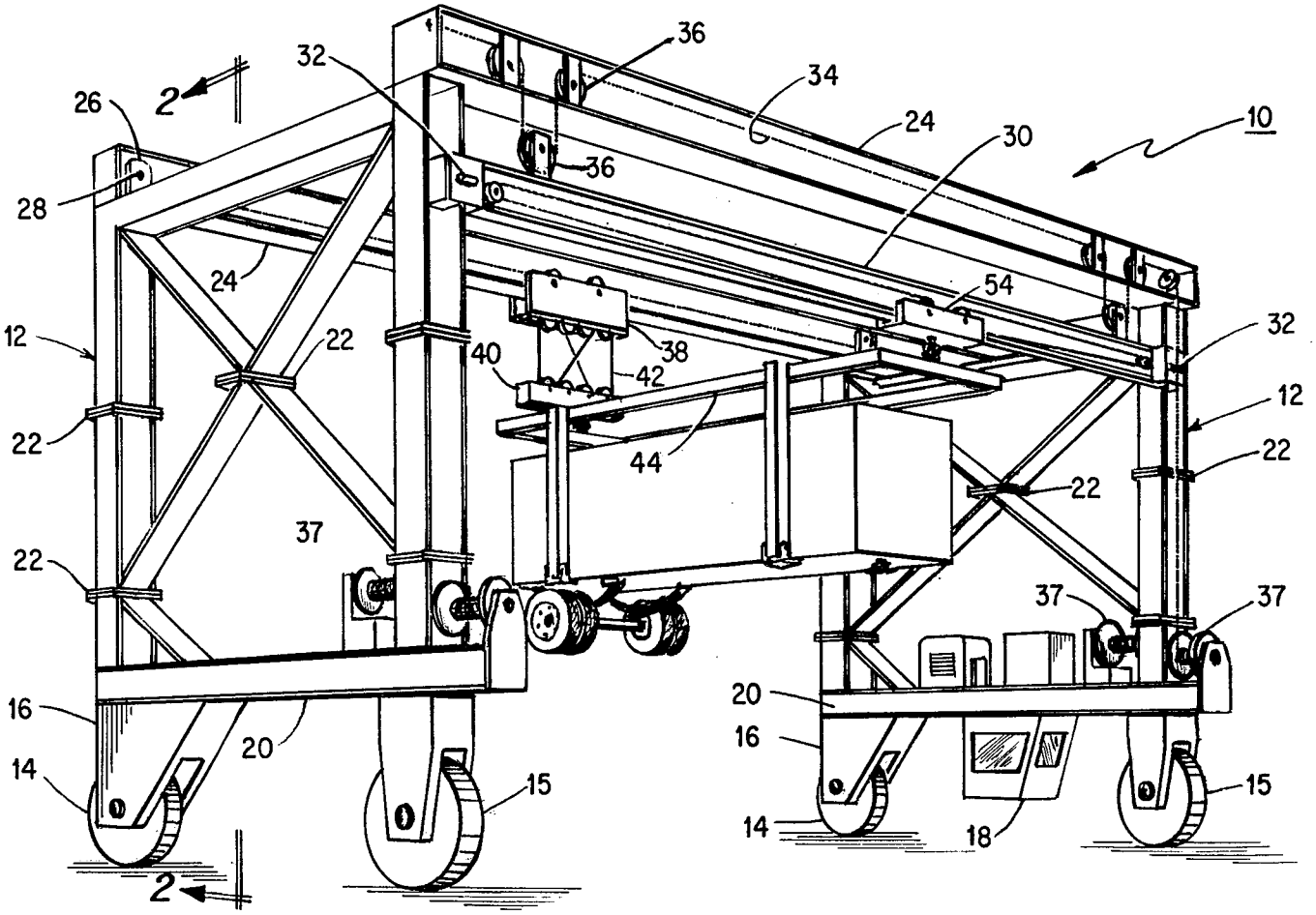
FIG. 1 is a perspective view of a load handling apparatus according to the precepts of the present invention having an anti-sway characteristic included therein.

Referring to the drawings as best seen in FIG. 1, the load handling apparatus 10 generally includes a pair of spaced upright support frames 12 which can be stationarily positioned or can be made mobile by utilizing a wheel configuration having wheels 14 and 15 for transport of the entire load handling apparatus 10 structure. For the mobile type load handling apparatus 10 generally two wheels 14 will be stationary in alignment with the spaced upright support frames 12 such as by the gusset supports 16 of wheels 14 and the other two wheels 15 will be capable of rotational movement so as to provide steering for the load handling apparatus 10. These steering wheels 15 also contain the drive mechanism for the load handling apparatus 10. Those skilled in the art could just as easily have the drive mechanism on wheels 14. Generally there will be a cab or station 18 from which a workman can control and operate the load handling apparatus 10. The power generating and pump mechanisms in addition to motors necessary for the operation of the device can be placed conveniently upon one of the horizontal chassis supports 20 of one or both of the spaced upright support frames 12.

The spaced upright support frames 12 can be built in sections so as to provide the capability of additional height as desired by adding additional sections to the upright support frames at any of the points for disconnect 22. This will allow the spaced upright support frames 12 to be built to any desired height for use under various circumstances.

Figure 2:
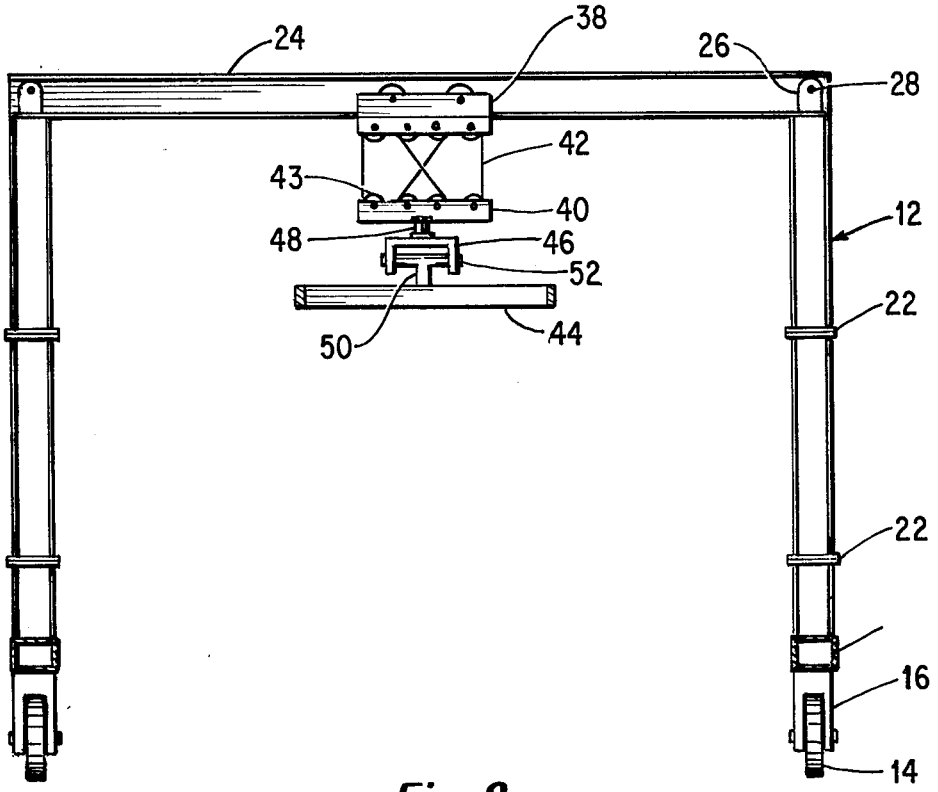
FIG. 2 is a sectional view of the spaced upright support beams with the cross member inter-connecting the two in a pivotal arrangement taken substantially along line 2—2 of FIG. 1.

Connecting the pair of spaced upright support frames 12 will be at least one cross member 24. The cross members 24 will be connected to the spaced upright support frames 12 at their furthest extent usually except that those skilled in the art can devise numerous ways of making such inter-connection between the spaced upright support frames 12 such as by placing a cross member 24 between the top centers of the spaced upright support frames 12. The load handling apparatus 10 will generally require the use of a relatively flat surface if the cross members 24 are connected to the upright support frames 12 in a fixed or permanent manner. To allow the load handling apparatus 10 the ability to move over rough or uneven surfaces, one such cross member 24 can be attached in a pivotal manner as seen in FIG. 2 of the drawings wherein for instance the upright support frames 12 can terminate in a clevis bracket 26 into which the cross member 24 can be inserted with a pivot pin 28 for limited pivotal movement about the pivot pin 28. A limited movable pivot point of this type will allow the load handling apparatus 10 to traverse rough or uneven surfaces with all of the wheels 14 and 15 being maintained in contact with the surface. Normally a fixed frame device when traversing an uneven of rough surface would encounter a lifting of one of the wheels 14 or 15 off the ground by such a height as to lessen the stability of the device and also reduce its power capability for traversing the rough surface in addition to perhaps causing gyrations of the load being carried.

Figure 4:
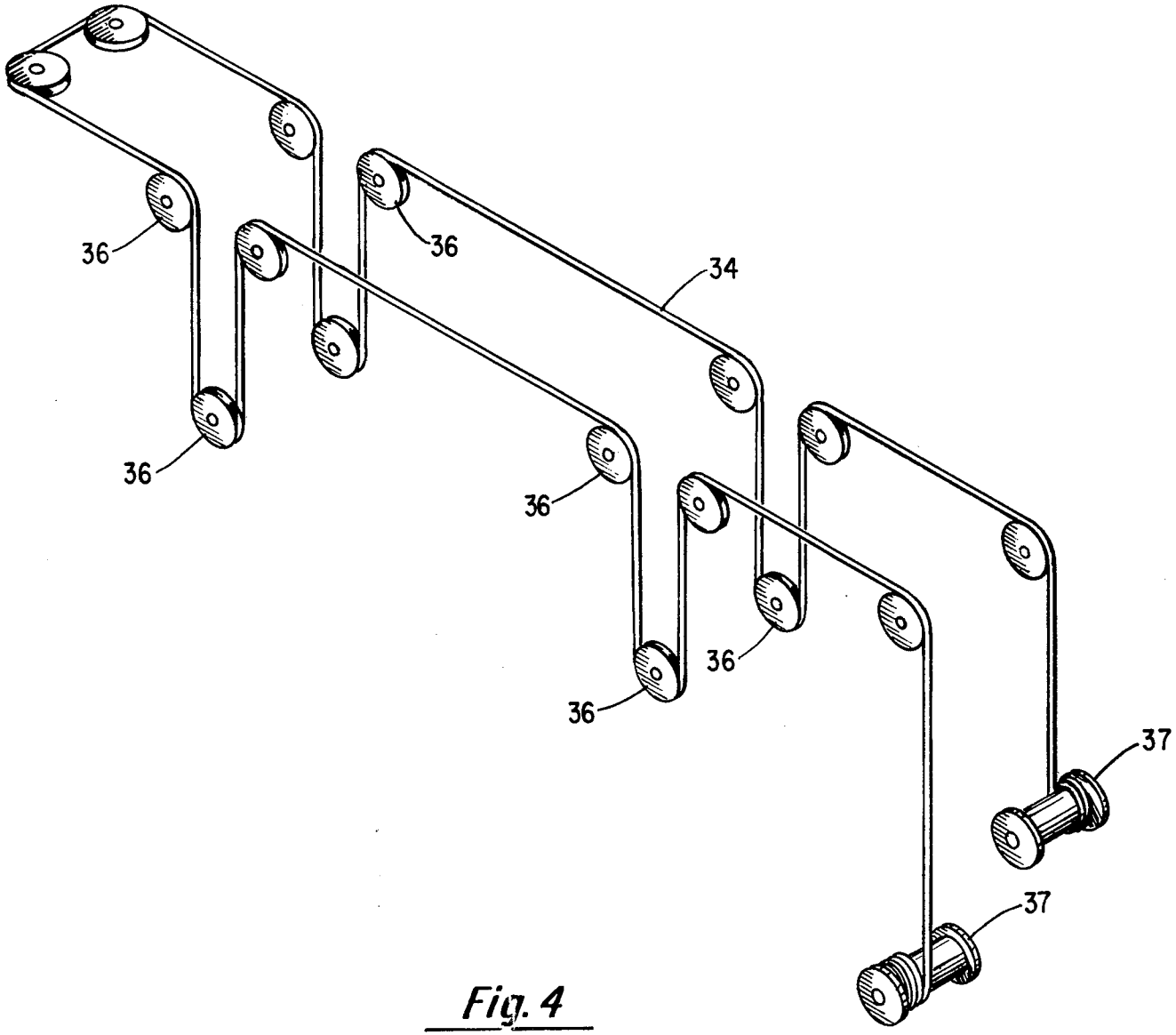
FIG. 4 is a reeving diagram for the stabilizing beam suspension.

Suspended between the upright support frames 12 is a stabilizing beam 30. The stabilizing beam 30 may be suspended from the upright support frames 12 in a number of conventional ways to allow vertical movement of the stabilizing beam 30 along the guideways upon the upright support frames 12. Extra structural integrity may be provided by adding a second cross member 24 rigidly connected to the spaced upright support frames 12 from which the stabilizing beam 30 may be suspended as shown amply in FIG. 1 of the drawings. A convenient way for providing smooth operation of the stabilizing beam 30 is to provide end and side thrust rollers 32 which engage three sides of a vertical portion of the upright support frames 12. A preferred method of providing vertical movement of the stabilizing beam 30 is by reeving 34 strung through a series of pulleys 36 at both ends of the stabilizing beam 30 in accordance with the reeving diagram of FIG. 4. Continuous reeving of this type permits the use of a single winch with dual coil cylinders 37 to raise and lower simultaneously both ends of the stabilizing beam 30 without any concern for cable stretch causing a need for adjustment of the cable lengths. The reeving 34 is automatically and continuously adjusted at both ends by the winding mechanisms 37.

Figure 5:
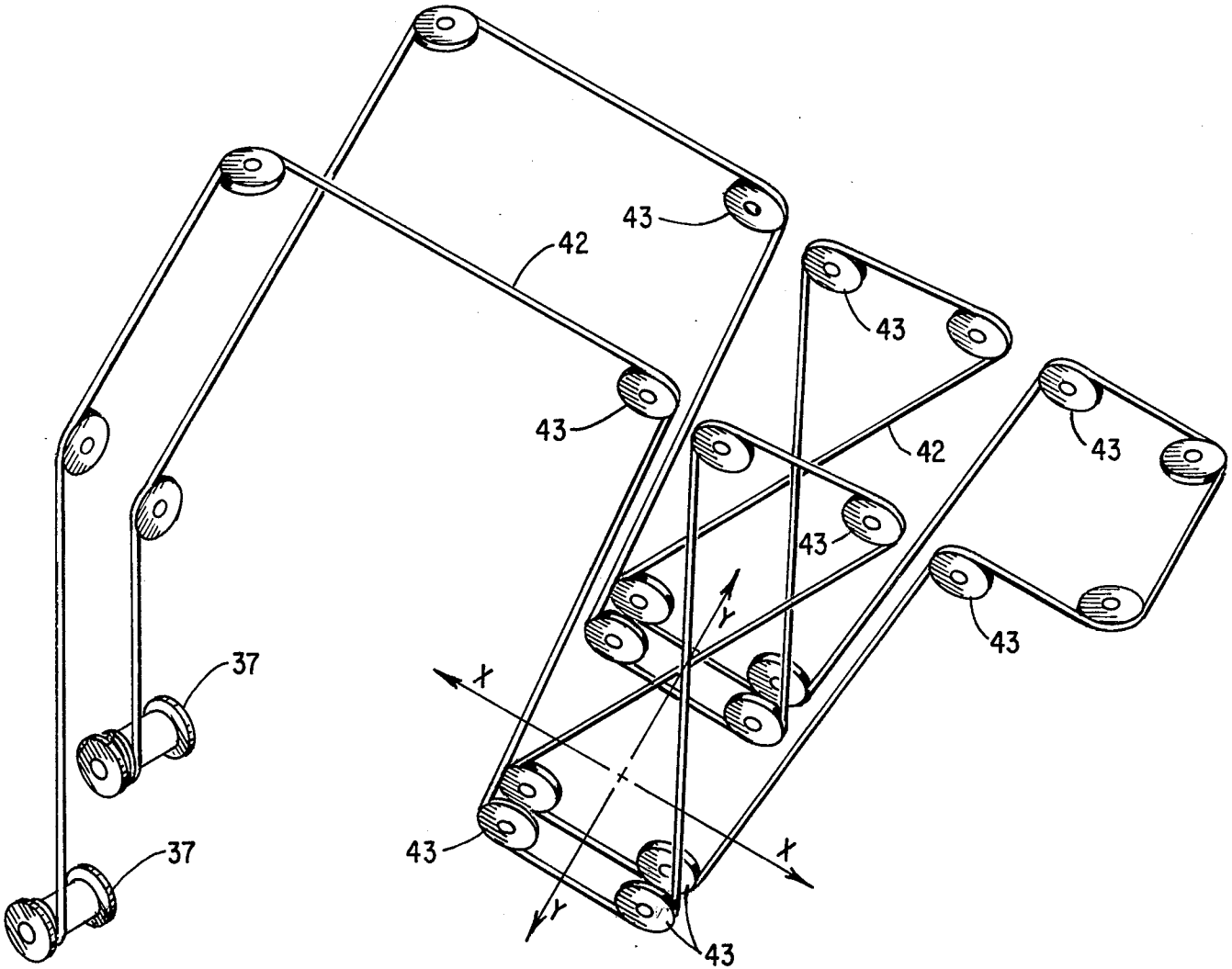
FIG. 5 is a reeving diagram for the first trolley sheave block.

A first trolley 38 movable laterally is suspended upon a cross member 24 such that it may be driven laterally with a continuous chain or cable drive to provide infinite variation of the first trolley 38 upon the cross member 24 to any desired position thereon. The first trolley will generally be upon the cross member 24 which is at the opposite end of the spaced upright support frames 12 from the stabilizing beam 30. Suspended from the first trolley 38 will be a sheave block 40 which is movable vertically with relation to and connected to the first trolley 38. The support providing for the vertical movement of the sheave block 40 is reeving 42 between the sheave block 40 and the first trolley 38 strung in such a manner as to allow translational movement of the sheave block 40 along one axis only with respect to the first trolley 38. An example of such reeving 42 may be seen in FIG. 5 of the drawings. As seen in FIG. 5, four pulleys 43 are positioned end to end along each side of the first trolley 38 and four pulleys 43 are positioned in two pairs of two each end to end on each side of the sheave block 40. This reeving arrangement will resist any movement along the X axis as seen in FIG. 5 while allowing movement along the Y axis which coincides with the major axis of a load bearing means 44 for carrying the load as seen in FIGS. 1 and 2 unless the load bearing means 44 is angularly disposed with relation to the load handling apparatus 10. It should also be noticed that continuous reeving is used similar to reeving 34 for the advantages attendant thereto. Those skilled in the art will readily realize that there are other reeving systems which will also provide such a translational movement along one axis only as is desired in the instant invention.

The sheave block 40 is then connected to the means 44 for bearing the load which is to be carried by the load handling apparatus 10. Such a load bearing means 44 may be a beam carrying various grappler arms or hooks or cables or chains, or some type of specifically designed spreader as is known in the art to be used for lifting cargo containers or the trailers from tractor trailer rigs. There are of course many designs for spreaders which are available; any one of which could be connected to the anti-sway device of the instant invention as presented herewith. The manner of connecting the load bearing means 44 to the sheave block 40 however must be done by means for connecting the two so as to allow rotational movement on the horizontal plane and vertical angular movement along the major axis of the load bearing means 44 at each end thereof.

One preferred connection means for making such a connection between the load bearing means 44 and the sheave block 40 is to use a combination of a swivel and a trunnion arrangement connected in such a way that the trunnion will swing in line with the major axis of the load bearing means 44. One such arrangement can be amply seen in FIG. 2 wherein a clevis bracket 46 has a swivel mounting 48 in the sheave block 40 and the load bearing means 44 has a tongue 50 which is secured to the clevis bracket by a trunnion 52 to provide the vertical angular movement along the major axis of the load bearing means 44. This arrangement could just as easily be reversed by having the clevis bracket 46 permanently attached to the load bearing means 44 and the tongue 50 having a swivel mounting in the sheave block 40. The swivel mounting 48 in the sheave block 40 provides the rotational movement on the horizontal plane which is necessary for the independent operation in opposite directions of the trolleys 38 and 54 while the clevis bracket 46 and trunnion 52 provide the vertical angular movement such that one end of the load bearing means 44 may be vertically raised or lowered independent of the other end.

Figure 3:
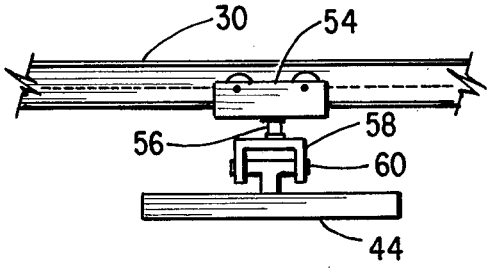
FIG. 3 is an elevation view of the second trolley load bearing means arrangement.

At the other end of the load bearing means 44 and at the other end of the major axis of load bearing means 44 is a second trolley 54 which is movable laterally upon the stabilizing beam 30 by convenient chain drive or cable drive means such as to be independent of the drive mechanism of the first trolley 38. This permits angular disposition of the load bearing means 44 by utilizing the independent drives of trolleys 38 and 54 to move in opposite directions along cross member 24 and stabilizing beam 30 for an angular disposition with respect to the relation of cross member 24 and stabilizing beam 30. The load bearing means 44 should be mounted to the second trolley by means of a swivel mounting 56, clevis bracket 58, and trunnion 60 similar to the mounting system to the sheave block 40. The swivel mounting 56 allows rotational movement on the horizontal plane about the pivot point of swivel mounting 56 on the second trolley 54 and the clevis bracket 58 and trunnion 60 allow vertical angular movement as seen in FIG. 3 of the drawings.

Constructing an anti-sway device in this way allows only rotational movement in the horizontal plane and vertical angular movement of the load bearing means 44 while particularly resisting any translational movement on the load bearing means 44 along the major axis thereof against the stabilizing beam 30. Also because of this connection with the second trolley 54, when the second trolley 54 is locked in position on the stabilizing beam 30, no translational movement of the load bearing means 44 is permitted along the minor axis of the load bearing means 44 either.

Thus, it is apparent to those skilled in the art from the foregoing description of the preferred embodiments and drawings presented that the instant invention of an anti-sway load handling apparatus has been provided which solves the problems attendant to such devices and accomplishes the objects of the invention.

What is claimed is:

1. A load handling apparatus comprising:

a pair of spaced upright support frames;

at least one cross member connected between said spaced upright support frames;

a stabilizing beam vertically movable on said spaced upright support frames;

a first trolley movable laterally upon said cross member in spaced apart relation on said spaced upright support frames from said stabilizing beam;

a sheave block movable vertically with relation to and connected to said first trolley;

load bearing means for bearing the load connected to said sheave block;

connection means for connecting said load bearing means to said sheave block to allow rotational movement on the horizontal plane and vertical angular movement along the major axis of said load bearing means;

a second trolley movable laterally upon said stabilizing beam;

said load bearing means connected to said second trolley at the opposite end of its major axis from said sheave block to allow rotational movement on the horizontal plane and vertical angular movement along the major axis of said load bearing means; and reeving connecting said sheave block to said first trolley to allow translational movement along the major axis of said load bearing means while resisting all other movement of said load bearing means in relation to said first trolley.

2. A load handling apparatus according to claim 1 wherein said first and second trolleys can be operated independently of each other.

3. A load handling apparatus according to claim 1 wherein said means for connecting said load bearing means to said sheave block comprises: a swivel mounting having a pivot point located in said sheave block; a clevis at the other end thereof for connecting to a vertical tongue of said load bearing means by means of a horizontally disposed trunnion through said clevis; and said trunnion connected to said tongue.

4. A load handling apparatus according to claim 1 wherein said load bearing means is connected to said second trolley by means of a swivel mounting located in said second trolley.

5. A load handling apparatus according to claim 1 wherein said means for connecting said load bearing means to said sheave block comprises: a swivel having a pivot point located in said sheave block; and a clevis extending from said spreader for connection to said swivel by means of a horizontally disposed trunnion connected to said swivel and through said clevis.

6. A load handling apparatus according to claim 1 wherein said first trolley and said sheave block have pulleys for receiving reeving for providing vertical movement of said sheave block.

7. A load handling apparatus according to claim 6 wherein said reeving is strung through said pulleys of said first trolley and said sheave block to allow translational movement along the major axis of said load bearing means while resisting movement in all other directions.

8. A load handling apparatus according to claim 7 wherein said reeving is strung in a continuous manner to provide continuous adjustment of said reeving.

9. A load handling apparatus according to claim 1 having wheels connected to the lower end of said spaced upright support frames.

10. A load handling apparatus according to claim 9 wherein at least one of said cross members is connected to said spaced upright support frames in a pivotal manner to allow the load handling apparatus to traverse uneven surfaces while maintaining all wheels in contact with the surface traversed.

11. A load handling apparatus according to claim 10 wherein said pivotal connection is a clevis bracket on the ends of said spaced upright support frames into which said cross member is inserted and retained in place by a pivot pin.

12. A load handling apparatus consisting essentially of:

a pair of spaced upright support frames having wheels upon which to traverse a surface by means of a drive mechanism;

a first cross member connected between spaced upright support frames;

a second cross member pivotally connected to and between said upright support frames in a spaced apart relation to said first cross member;

a stabilizing beam vertically movable on said spaced upright support frames suspended from said first cross member by means for providing vertical movement;

a first trolley movable laterally upon said second cross member;

a sheave block movable vertically with relation to and and connected to said first trolley by reeving allowing translational movement along the major axis of a load bearing means only;

a load bearing means for bearing the load connected to said sheave block to allow rotational movement on the horizontal plane and vertical angular movement along the major axis of said load bearing means; and said load bearing means connected to said second trolley at the opposite end of its major axis from said sheave block to allow rotational movement on the horizontal plane and vertical angular movement along the major axis of said load bearing means.

13. A load handling apparatus according to claim 12 wherein said first and second trolleys can be operated independently of each other.

14. A load handling apparatus according to claim 12 wherein said means for connecting said load bearing means to said sheave block comprises: a swivel mounting having a pivot point located in said sheave block; a clevis at the other end thereof for connecting to a vertical tongue of said load bearing means by means of a horizontally disposed trunnion through said clevis; and said trunnion connected to said tongue.

15. A load handling apparatus according to claim 12 wherein said load bearing means is connected to said second trolley by means of a swivel mounting located in said second trolley.

16. A load handling apparatus according to claim 12 wherein said sheave block and said first trolley have pulleys for receiving reeving for providing vertical movement of said sheave block.

17. A load handling apparatus according to claim 12 wherein said reeving is strung in a continuous manner through the pulleys of said first trolley and said sheave block to allow translational movement along the major axis of said load bearing means while resisting movement in all other directions.

18. An anti-sway device for a load handling apparatus comprising:

a first trolley movable laterally upon and connected to the load handling apparatus;

a stabilizing beam movable vertically on and connected to the load handling apparatus;

a second trolley movable laterally upon and connected to said stabilizing beam;

a load bearing means for bearing the load;

said load bearing means connected at one end to said second trolley to resist lateral sway and sway along the major axis of said load bearing means; and said load bearing means movable vertically from and connected at the other end thereof by reeving to said first trolley to resist lateral sway.

19. An anti-sway device for a load handling apparatus according to claim 18 further comprising connection means for connecting each end of said load bearing means to said first and said second trolleys allowing rotational movement in the horizontal plane and vertical angular movement along the major axis of said load bearing means.

20. An anti-sway device for a load handling apparatus according to claim 19 wherein said connection means comprises: a swivel mounting; a clevis bracket; and a trunnion connecting through said clevis bracket.

21. An anti-sway device for a load handling apparatus according to claim 20 wherein the vertical angular movement of said trunnion in said clevis bracket is along the major axis of said load bearing means.

22. An anti-sway device for a load handling apparatus according to claim 20 wherein said swivel mounting is connected to said clevis.

23. An anti-sway device for a load handling apparatus according to claim 21 wherein said swivel is connected to said trunnion.

* * * * *